US009246285B2

(12) United States Patent
Fransen et al.

(10) Patent No.: US 9,246,285 B2
(45) Date of Patent: Jan. 26, 2016

(54) NETWORK JACK WITH BACKWARDS CAPABILITY AND SYSTEMS USING SAME

(71) Applicant: Panduit Corp., Tinley Park, IL (US)

(72) Inventors: Robert E. Fransen, Tinley Park, IL (US); Shaun P. Brouwer, St. John, IN (US)

(73) Assignee: Panduit Corp., Tinley Park, IL (US)

( * ) Notice: Subject to any disclaimer, the term of this patent is extended or adjusted under 35 U.S.C. 154(b) by 130 days.

(21) Appl. No.: 14/204,448

(22) Filed: Mar. 11, 2014

(65) Prior Publication Data

US 2014/0273570 A1 Sep. 18, 2014

Related U.S. Application Data

(60) Provisional application No. 61/779,806, filed on Mar. 13, 2013.

(51) Int. Cl.

| | |
|---|---|
| ***H01R 29/00*** | (2006.01) |
| ***H01R 24/64*** | (2011.01) |
| ***H01R 27/00*** | (2006.01) |
| *H01R 13/66* | (2006.01) |
| *H01R 13/703* | (2006.01) |
| *H01R 107/00* | (2006.01) |

(52) U.S. Cl.

CPC ..... *H01R 24/64* (2013.01); *H01R 27/00* (2013.01); *H01R 29/00* (2013.01); *H01R 13/6658* (2013.01); *H01R 13/7032* (2013.01); *H01R 2107/00* (2013.01)

(58) Field of Classification Search

USPC ..... 439/188, 676

See application file for complete search history.

(56) References Cited

U.S. PATENT DOCUMENTS

| | | | |
|---|---|---|---|
| 3,354,355 | A | 11/1967 | Cliffgard et al. |
| 5,387,135 | A | 2/1995 | Shen et al. |
| 5,772,466 | A | 6/1998 | Morin et al. |
| 6,056,568 | A | 5/2000 | Arnett |
| 6,059,578 | A | 5/2000 | Arnett |
| 6,079,996 | A | 6/2000 | Arnett |
| 6,156,981 | A | 12/2000 | Ward et al. |
| 6,193,533 | B1 | 2/2001 | Win et al. |
| 6,244,907 | B1 | 6/2001 | Arnett |
| 6,244,908 | B1 | 6/2001 | Hammond et al. |
| 6,394,853 | B1 | 5/2002 | Hammond et al. |
| 6,482,019 | B1 | 11/2002 | Lo Forte et al. |
| 6,736,681 | B2 | 5/2004 | Arnett |
| 6,890,197 | B2 | 5/2005 | Liebenow |
| 7,241,157 | B2 | 7/2007 | Zhuang et al. |

(Continued)

FOREIGN PATENT DOCUMENTS

| | | | |
|---|---|---|---|
| EP | 0739058 | A1 | 10/1996 |
| WO | 2009100296 | A1 | 8/2009 |

*Primary Examiner* — Tho D Ta

(74) *Attorney, Agent, or Firm* — Christopher S. Clancy; Yuri Astvatsaturov

(57) ABSTRACT

The present invention relates to the field of telecommunication jacks, and more specifically, to network jacks adapted for operating with more than one type of a plug. In an embodiment, the present invention is a communication connector that includes a housing configured to receive a communication plug, a printed circuit board connected to the housing, and a rocker switch pivotally connected to the housing, the rocker switch configured for actuating the printed circuit board. In a variation of this embodiment, the communication connector could be used in a communication system having communication equipment therein.

20 Claims, 10 Drawing Sheets

(56) References Cited

U.S. PATENT DOCUMENTS

| | | | | |
|---|---|---|---|---|
| 7,985,101 | B2 | 7/2011 | Fitzpatrick | |
| 7,993,166 | B1 | 8/2011 | Kline | |
| 8,100,701 | B2 | 1/2012 | Gerber et al. | |
| 2005/0059301 | A1 | 3/2005 | Chou et al. | |
| 2005/0087429 | A1 * | 4/2005 | Blossfeld | H01H 1/5805 200/5 R |
| 2007/0270044 | A1 | 11/2007 | Belopolsky et al. | |
| 2008/0254674 | A1 | 10/2008 | Liao | |
| 2008/0318475 | A1 | 12/2008 | Poo et al. | |
| 2009/0108848 | A1 | 4/2009 | Lundquist et al. | |
| 2009/0186532 | A1 | 7/2009 | Goodrich et al. | |
| 2010/0136848 | A1 | 6/2010 | Lin et al. | |
| 2010/0173528 | A1 | 7/2010 | Martich et al. | |
| 2012/0168524 | A1 * | 7/2012 | Moore | F24F 11/0012 236/1 C |

* cited by examiner

NETWORK JACK WITH BACKWARDS CAPABILITY AND SYSTEMS USING SAME

CROSS-REFERENCE TO RELATED APPLICATIONS

This application claims the benefit of U.S. Provisional Patent Application No. 61/779,806, filed on Mar. 13, 2013, which is incorporated herein by reference in its entirety.

FIELD OF INVENTION

The present invention relates to the field of telecommunication jacks, and more specifically, to network jacks adapted for operating with more than one type of a plug.

BACKGROUND

The use of electronic equipment such as personal computers, servers, and other network operable devices has continued to progress over the past decades. This progression has been accompanied by an increased need to transfer large amounts of data at ever-increasing speeds and the resulting requirement of a sufficiently powerful network infrastructure. One particular area of concentration within network infrastructure has been the plug/jack mating region together with the individual plug and jack components. It is within these components that increasing crosstalk often occurs at high bandwidths.

As of today, the RJ45 connector has been one of the commonly used standards for making electrical connections within a network. While this standard is widely employed, the physical layout of electrical conductors in an RJ45 connector can cause increasing levels of crosstalk at higher bandwidths. To combat unwanted crosstalk, new plug/jack designs have been implemented. However, to ensure the ability to interface RJ45 components to new networks, it is desirable to have the new plug/jack designed be backwards compatible.

One such design is commonly referred to as GG45. A GG45 jack may provide channel backwards compatibility for standard RJ45 plugs where eight conductors are used for Category 6 (CAT6) (100/250 MHz) and Category 6A (CAT6A) (500 MHz) operation. Furthermore, a GG45 connector generally includes four additional conductors (two conductor pairs) in the corners of the plug aperture opposite of the RJ45 plug interface contacts (PICs) that interface with networks such as the high-speed Category 7 (CAT7) 600 MHz and Augmented Category 7 (CAT7A) 1000 MHz, or higher frequency, networks. A CAT6 or CAT6A plug uses the original 1-8 PICs (RJ45 mode), but a CAT7 or CAT7A ARJ45 plug instead uses the two pairs of contacts in the corners of the plug aperture and the 1,2 and 7,8 RJ45 PICs (GG45 mode). A protrusion on the nose of the ARJ45 plug actuates the jack for the alternative contact positions. In RJ45 CAT6A mode compensation circuitry is used in the connector; however, in GG45 mode the compensation circuitry may not be needed because of the separation of the plug interface contacts used in this mode in both the ARJ45 plug and the GG45 jack.

Some designs of GG45 jacks are known. However, these designs often exhibit high levels of mechanical complexity which can detract from reliability. Also, known designs exhibit electrical problems such as electrical imbalance (common mode to differential mode conversion and vice versa), relatively high return loss, and relatively high insertion loss for some of the conductor pairs.

Thus, there exists a need for a switchable jack with a cost effective and reliable method of actuation between RJ45 and switched high bandwidth modes, which has minimal impact on jack electrical performance.

SUMMARY

Accordingly, at least some embodiments of the present invention are directed to switchable communication jacks and the components thereof.

In one embodiment, the present invention is a communication connector that includes a housing configured for receiving a communication plug, a printed circuit board connected to the housing, and a rocker switch pivotally connected to the housing, the rocker switch configured for actuating the printed circuit board. In a variation of this embodiment, the communication connector could be used in a communication system having communication equipment therein.

In another embodiment, the present invention is a method of connecting a communication jack with one of a first type of a plug and a second type of a plug, the first type of a plug being different from the second type of a plug. The method includes providing the communication jack including a housing and plug interface contacts at least partially within the housing having at least a first contact pair and a second contact pair, engaging a coupling circuitry between the first contact pair and the second contact pair when the first type of a plug is inserted into the housing, pivoting a switch connected to the coupling circuitry, and translating the coupling circuitry via the switch from a first position to a second position when the second plug is inserted into the housing.

In yet another embodiment, the present invention is a communication connector operable with a first type of a plug corresponding to a first mode of operation and a second type of a plug corresponding to a second mode of operation, the first type of a plug being different from the second type of a plug. The communication connector includes a housing including a plug receiving aperture, a plug interface contact (PIC) support structure connected to the housing, a first plurality of adjacently positioned PICs in the plug receiving aperture and supported by the PIC support structure, the first plurality of PICs having a first subset of first contact pairs and a second subset of first contact pairs, the first subset of first contact pairs configured to interface the first type of a plug and the second type of a plug, the second subset of first contact pairs configured to interface the first type of a plug but not the second type of a plug, a second plurality of PIC positioned non-adjacently to the first plurality of PICs, the second plurality of PICs configured to interface the second type of a plug but not the first type of a plug, and a plurality of ground contacts at least partially within the housing for providing a signal ground for the first subset of first contact pairs when the communication connector is in the second mode of operation, the plurality of ground contacts providing ground balance for each first contact pair of the first subset of first contact pairs.

These and other features, aspects, and advantages of the present invention will become better understood with reference to the following drawings, description, and any claims that may follow.

DESCRIPTION

In one embodiment, the present invention is a switchable jack with an improved switching mechanism adapted to move a PCB between two different modes of operation, wherein said switching mechanism includes a pivoting rocker switch with an arm to efficiently convert the horizontal insertion and removal of an ARJ45 plug to a vertical motion of the switching PCB. The improved switching mechanism can reduce frictional losses while also improving its ability to accurately position the PCB for both the RJ45 and high bandwidth modes of operation. In at least one embodiment, the switchable jack of the present invention can accept an RJ45 plug or ARJ45 plug and is compliant with IEC 60603-7-7.

Figure 1:
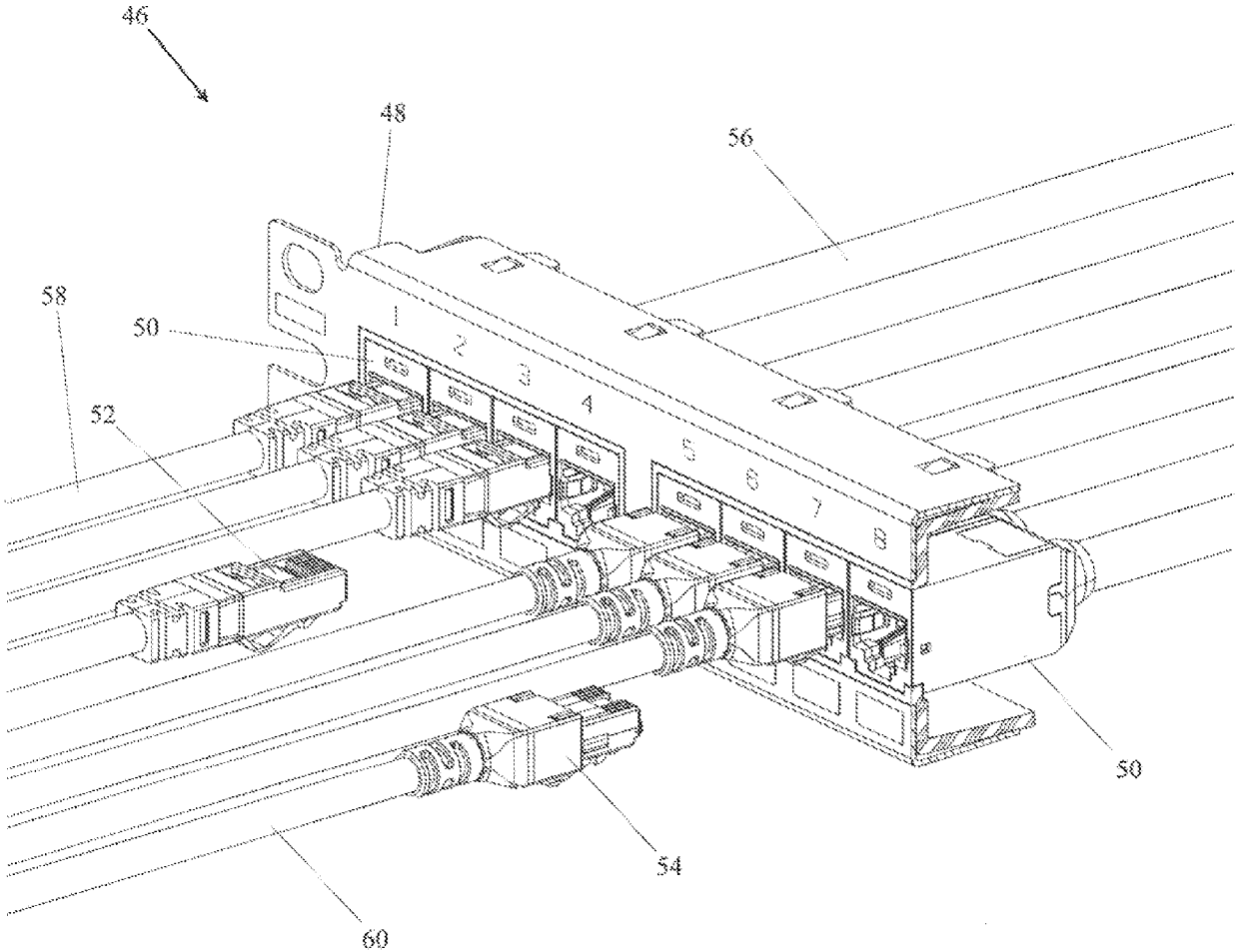
FIG. 1 illustrates a communication system according to an embodiment of the present invention.

FIG. 1 illustrates an embodiment of the present invention with a copper structured cabling communication system 46 which includes a patch panel 48 with switchable jacks 50, and corresponding RJ45 plugs 52 and ARJ45 plugs 54. Respective horizontal cables 56 are terminated to switchable jacks 50, respective patch cables 58 are terminated to RJ45 plugs 52, and respective shielded patch cables 60 are terminated to ARJ45 plugs 54. Once RJ45 plugs 52 or ARJ45 plugs 54 mate with switchable jacks 50 data can flow in both directions through these connectors. Although communication system 46 is illustrated with a patch panel in FIG. 1, alternative embodiments can include other active or passive equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers and telecommunications rooms; security devices (cameras and other sensors, etc.) and door access equipment; and telephones, computers, fax machines, printers and other peripherals as can be found in workstation areas. Communication system 46 can further include cabinets, racks, cable management and overhead routing systems, and other such equipment. Cables 56, 58, 60 can be used in a variety of structured cabling applications including patch cords, zone cords, backbone cabling, and horizontal cabling, although the present invention is not limited to such applications. In general, the present invention can be used in military, industrial, telecommunications, computer, data communications, marine and other cabling applications.

Figure 2:
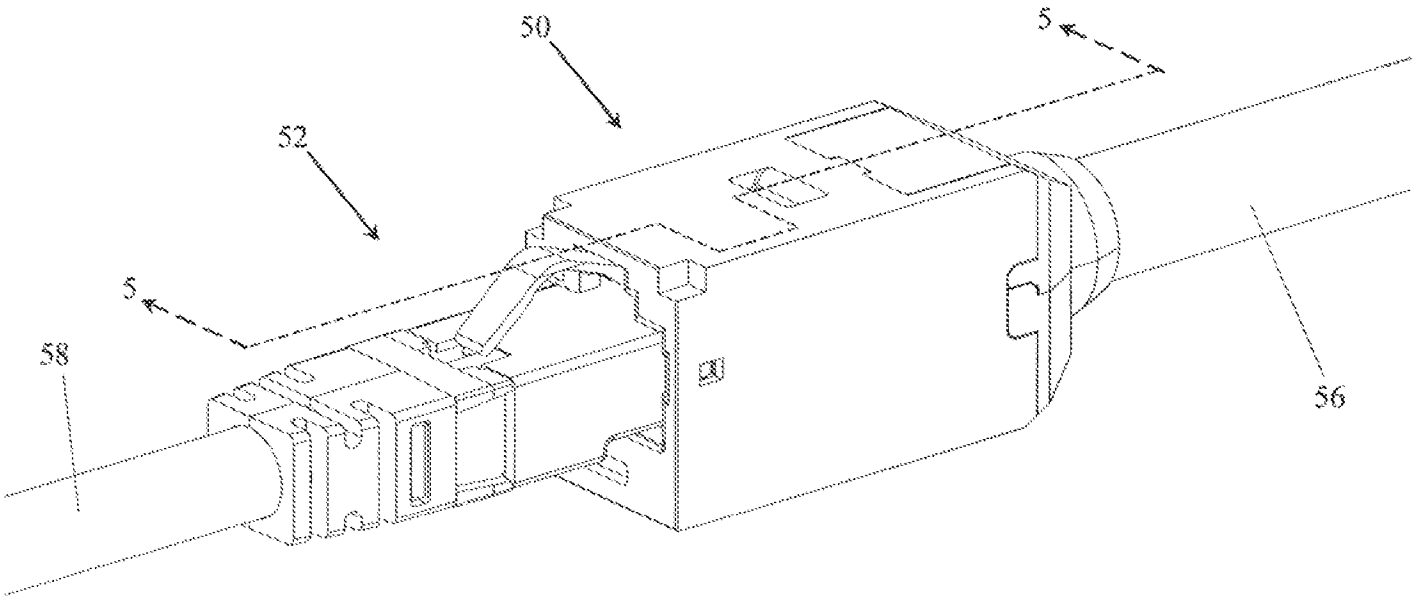
FIG. 2 illustrates a communication jack mated to a communication plug according to an embodiment of the present invention.
Figure 3:
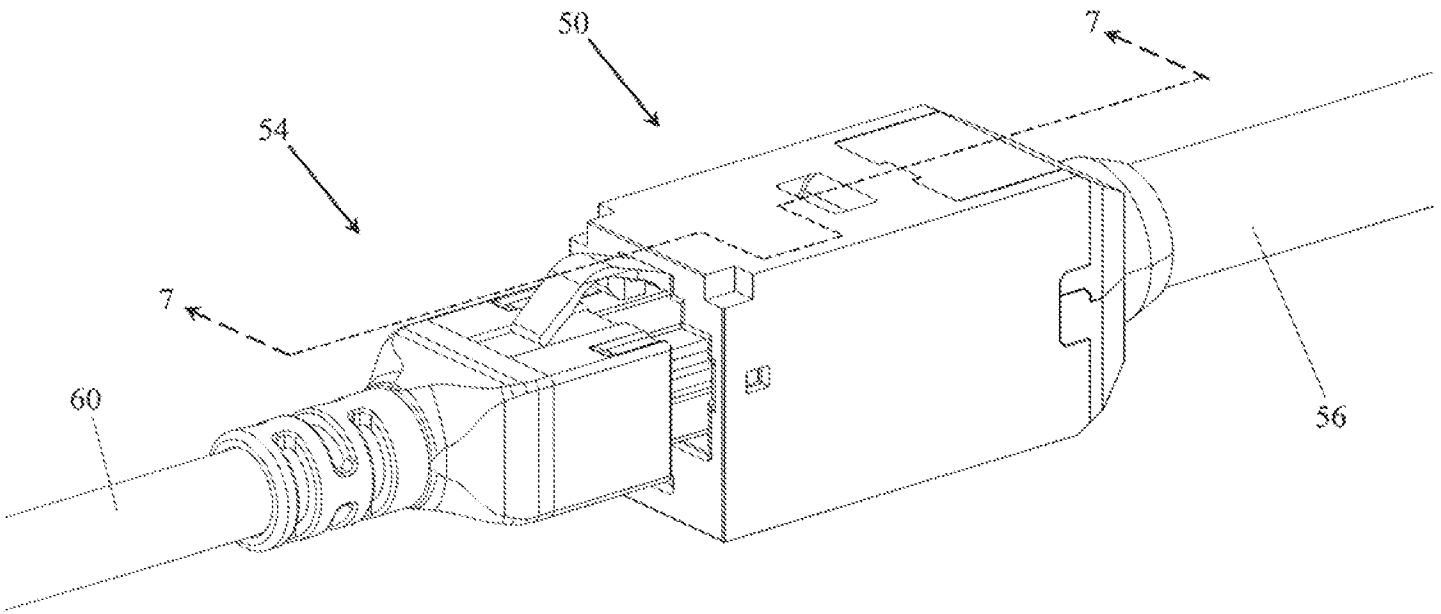
FIG. 3 illustrates a communication jack mated to a communication plug according to another embodiment of the present invention.

FIG. 2 shows a switchable jack 50, according to one embodiment of the present invention, mated with an RJ45 plug 52. Note that relative to the orientation from FIG. 1, this assembly is rotated 180° about the central axis of cable 56. FIG. 3 shows a switchable jack 50, according to one embodiment of the present invention, mated with an ARJ45 plug 54. Note that relative to the orientation from FIG. 1, this assembly is rotated 180° about the central axis of cable 56.

Figure 4A:
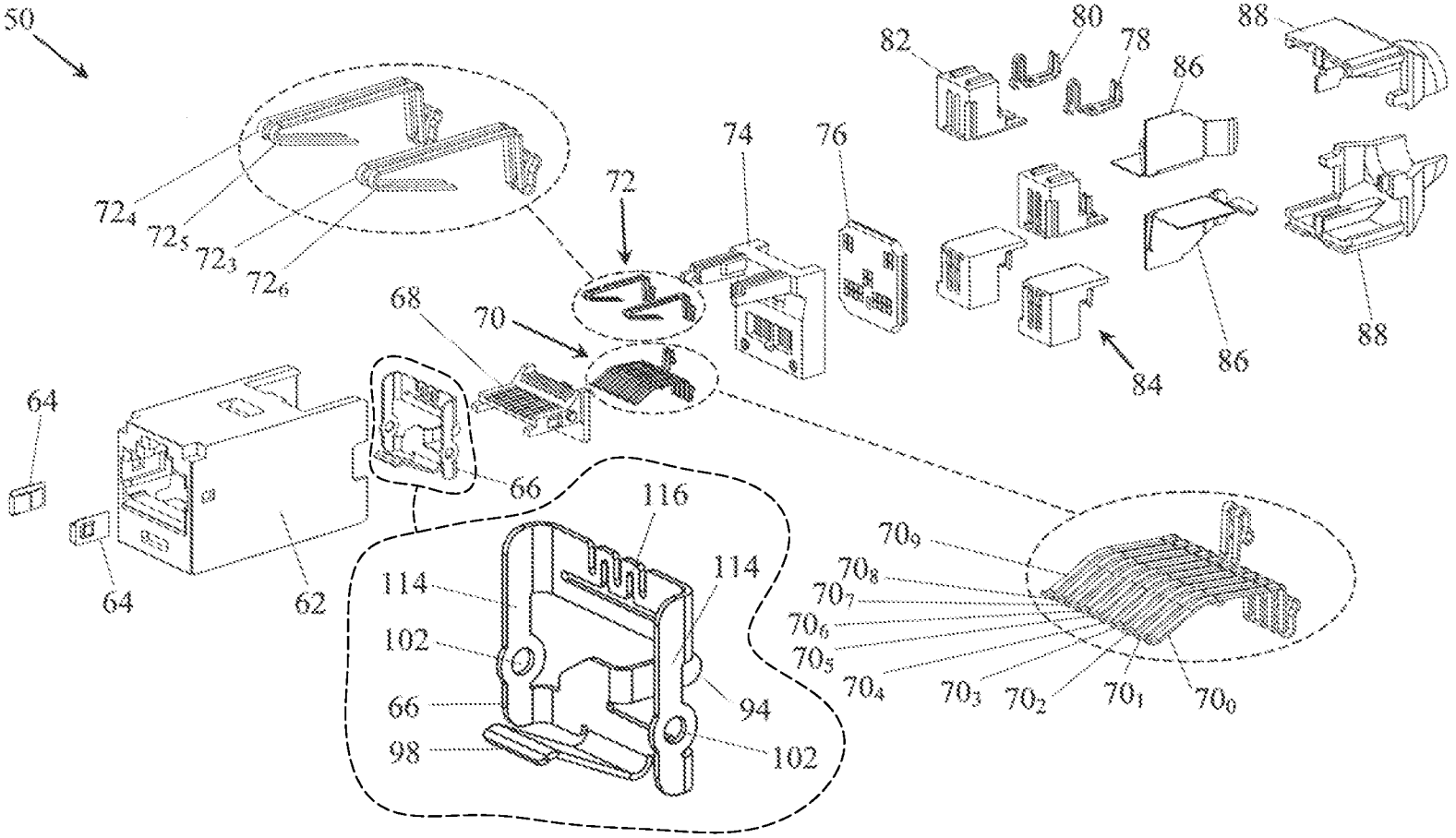
FIG. 4A illustrates an exploded view of a communication jack according to an embodiment of the present invention.
Figure 4B:
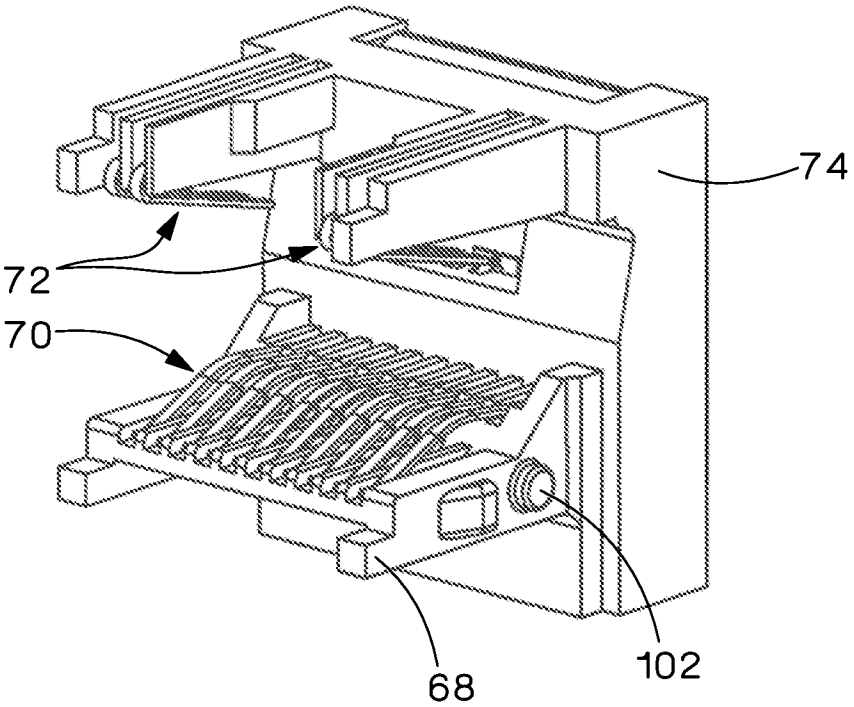
FIG. 4B illustrates a PIC support structure with PICs assembled thereto according to an embodiment of the present invention.

FIG. 4A shows an exploded view of the switchable jack 50 according to one embodiment of the present invention. In this embodiment, switchable jack 50 includes a metal housing 62 and plug grounding tabs 64 which are used to make an electrical bond between a shielded plug and the metal housing 62. Rocker switch 66 toggles switchable jack 50 between the RJ45 and switched high bandwidth modes of operation based on which type of plug is inserted. The front plug interface contacts (PIC) support structure 68 holds rocker switch 66 via axles 101 (both sides) which protrude into apertures 102. Support structure 68 also combs PICs 70 with comb elements and helps further constrain PICs 70 as shown particularly in FIG. 4B. Depending on whether switchable jack 50 is used with an RJ45 plug or an ARJ45 plug, data flows through different sets of conductors. In this particular embodiment, switchable jack 50 includes PICs $\mathbf{70}_0$-$\mathbf{70}_9$ and PICs $\mathbf{72}_3$-$\mathbf{72}_6$. When switchable jack is operating in the RJ45 mode with an RJ45 plug connected to the jack, data flows between the jack and the plug through PICs $\mathbf{70}_1$, $\mathbf{70}_2$, $\mathbf{70}_3$, $\mathbf{70}_4$, $\mathbf{70}_5$, $\mathbf{70}_6$, $\mathbf{70}_7$, and $\mathbf{70}_8$, wherein each of the 1-8 subscript numbers corresponds to the 1-8 plug contacts generally found in an RJ45 plug, respectively. In a preferred embodiment, when operating in the RJ45 mode PICs $\mathbf{72}_3$-$\mathbf{72}_6$ are grounded. When switchable jack is operating in the high bandwidth mode with an ARJ45 plug connected to the jack, data flows between the jack and the plug through PICs $\mathbf{70}_1$, $\mathbf{70}_2$, $\mathbf{70}_7$, $\mathbf{70}_8$, $\mathbf{72}_3$, $\mathbf{72}_4$, $\mathbf{72}_5$, and $\mathbf{72}_6$, wherein each of the 1-8 subscript numbers corresponds to the 1-8 plug contacts generally found in a ARJ45 plug, respectively. In a preferred embodiment, when operating in the high bandwidth mode PICs $\mathbf{70}_3$-$\mathbf{70}_6$ are grounded.

While in the presently described embodiment PICs $\mathbf{70}_0$ and $\mathbf{70}_9$ are grounded and can be used to balance the ground around PICs $\mathbf{70}_1$, $\mathbf{70}_2$, $\mathbf{70}_7$, and $\mathbf{70}_8$ (as further detailed in U.S. patent application Ser. No. 13/632,211, titled "Backward Compatible Connectivity for High Data Rate Applications", filed Oct. 1, 2012, which is incorporated herein by reference in its entirety), other embodiments of the present invention may omit PICs $\mathbf{70}_0$ and $\mathbf{70}_9$ all together, or utilize said PICs for other objectives such as, for example, active cable management.

Rear PIC support structure 74 further constrains PICs 70 as well as holds PICs 72 and provides guides 104, 110 to assist with the positioning of PCB 76. PCB 76 can include two networks (not shown), or in other words coupling circuitry, one for RJ45 mode and one for high bandwidth mode. These networks can provide compensation for CAT6A requirements such as NEXT, FEXT, return loss and/or others; and signal connections for either CAT6A or higher bandwidth mode, for examples. Examples of such networks can be found in previously mentioned U.S. patent application Ser. No. 13/632,211. Left insulation displacement contact (IDC) 78 and right IDC 80 assemble to IDC support structure 82 to create IDC subassembly 84. Four IDC subassemblies 84 are used in the switchable jack 50. Two IDC isolators 86 separate IDC subassemblies 84 to reduce internal crosstalk among the four signal pairs. Two rear caps 88 assemble to metal housing 62 after horizontal cable 56 is terminated to IDCs 78 and 80 to complete the assembly of switchable jack 50. In a preferred embodiment, the IDC isolators 86 and caps 88 are metal. The PICs 70 and 72, PIC support structure 68, and rear PIC support structure 74 are shown in an assembled state in FIG. 4B.

Figure 5:
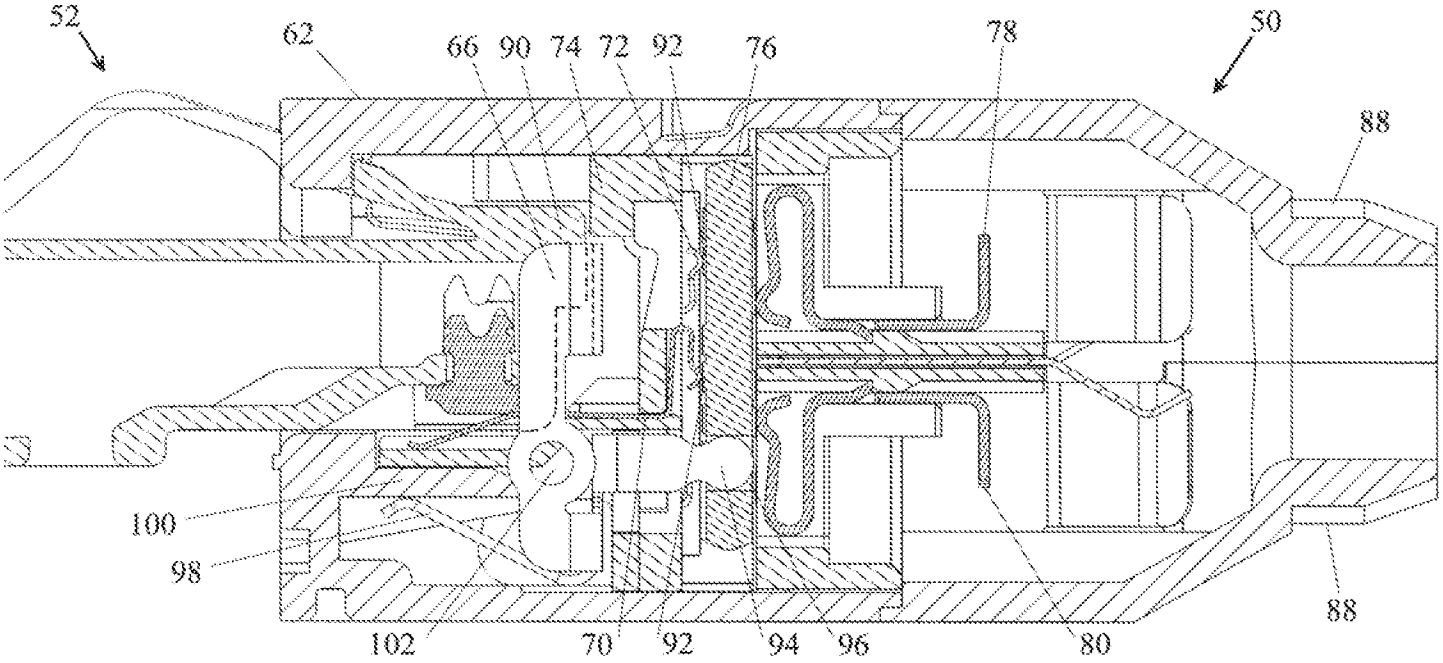
FIG. 5 illustrates a section view of the plug/jack combination of FIG. 2.
Figure 6:
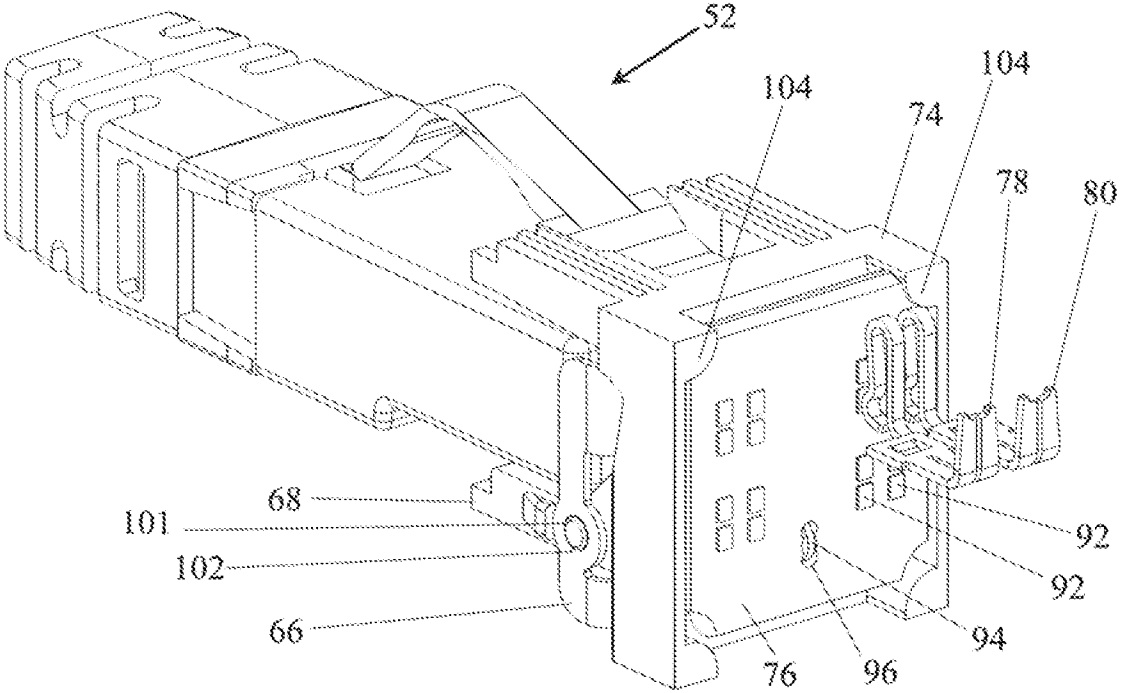
FIG. 6 illustrates a rear isometric view of the plug/jack combination FIG. 2 with some elements removed.

A sectional view of RJ45 plug 52 inserted into switchable jack 50 taken along section line 5-5 in FIG. 2 is shown in FIG. 5. Cables 56 and 58 have been removed for clarity. RJ45 plug 52 is inserted until RJ45 front nose 90 encounters rear PIC support structure 74. This ensures that RJ45 plug 52 does not touch rocker switch 66. In the RJ45 mode PCB 76 is positioned such that PICs 70 and 72 make contact with lower contact pads 92, as shown. Rocker switch 66 controls the vertical positioning of PCB 76. Arm 94 of rocker switch 66 links and can electrically bond to plated through hole 96 of PCB 76 to provide continuity of ground to PCB 76 if PCB 76 includes a ground plane or other ground structure. Spring arm 98 of rocker switch 66 pushes against shelf 100 of metal housing 62 in order to create a spring force and provide an electrical bond. Rocker switch 66 can pivot about aperture 102. The spring force generated between spring arm 98 and shelf 100 causes rocker switch 66 to rotate in a counter-clockwise manner (relative to the orientation shown in FIG. 5) about aperture 102. This moment translates to a vertically upward force onto PCB 76 through arm 94, which positions PCB 76 accordingly for the RJ45 mode of operation. A rear isometric view of FIG. 2 is shown in FIG. 6 with housing and three of the four IDC subassemblies removed to give additional perspective on the switching mechanism. Similar to PICs 70 and 72, IDCs 78 and 80 make contact with lower contact pads 92 during RJ45 mode of operation. Upper quarter-round features 104 of rear PIC support structure 74 limit the upward vertical and lateral movements, and assist with accurately positioning PCB 76 so that a reliable interface between respective contacts and contact pads can be attained.

Figure 7:
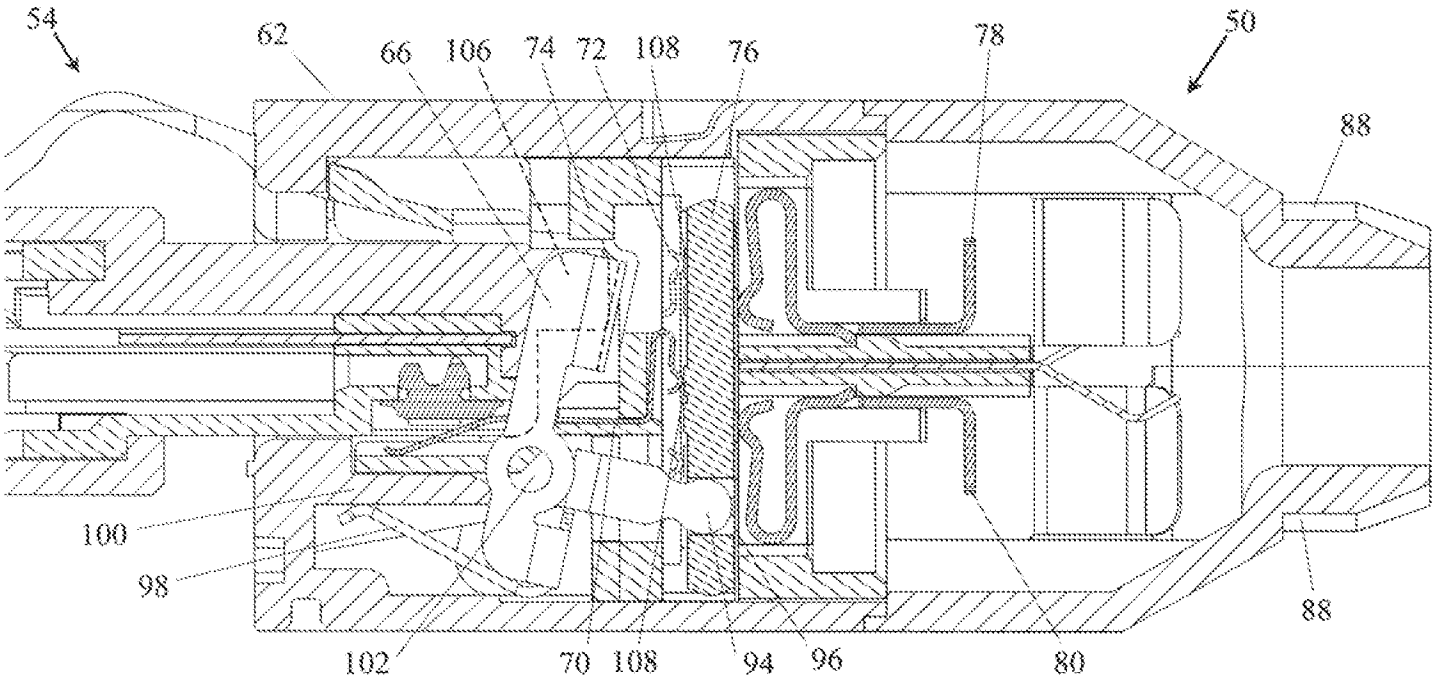
FIG. 7 illustrates a section view of the plug/jack combination of FIG. 3.
Figure 8:
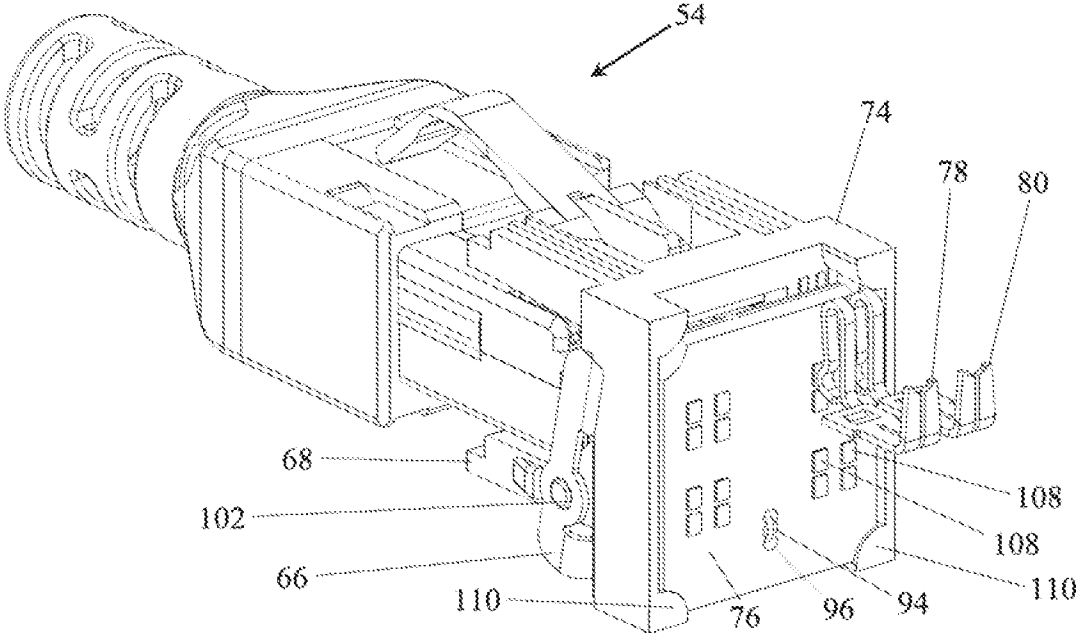
FIG. 8 illustrates a rear isometric view of the plug/jack combination FIG. 3 with some elements removed.

A sectional view of the ARJ45 plug 54 inserted into switchable jack 50 taken along section line 7-7 in FIG. 3 is shown in FIG. 7. Cables 56 and 60 have been removed for clarity. Unlike RJ45 plug 52, ARJ45 nose 106 of ARJ45 plug 54 slides past rear PIC support structure 74 and contacts rocker switch 66. As ARJ45 plug 54 continues to insert, rocker switch 66 pivots in a clockwise manner about aperture 102. This results in arm 94 driving PCB 76 in a vertically downward direction so that PICs 70 and 72 make contact with upper contact pads 108. Spring arm 98 further drives itself into shelf 100, creating an increased spring potential. A rear isometric view of FIG. 3 is shown in FIG. 8 with housing and three of the four IDC subassemblies removed to give additional perspective on the switching mechanism. Similar to PICs 70 and 72, IDCs 78 and 80 make contact with upper contact pads 108 when switchable jack 50 is in high bandwidth mode of operation. Lower quarter-round features 110 of rear PIC support structure 74 limit the downward vertical and lateral movements, and assists with accurately positioning PCB 76 so that a reliable interface between respective contacts and contact pads can be attained.

Rocker switch 66 is designed so that it drives PCB 76 down to lower-quarter round features 110 as long as rocker switch 66, front PIC support structure 68, rear PIC support structure 74, and PCB 76 are within standard manufacturing tolerances. Rocker switch 66 can elastically deform along beam arms 114 and nose deflection region 116 (FIG. 4) to account for the variation due to manufacturing tolerances. Rocker switch 66 alters the position of PCB 76 by providing the necessary vertical forces to move PCB 76 along the vertical axis. This design permits the horizontal force exerted by the plug to be efficiently translated to vertical force on the PCB, which may help decrease the required insertion force for ARJ45 plug 54 into switchable jack 50. When ARJ45 plug 54 is removed from switchable jack 50, the spring potential between arm 98 and shelf 100 is released, causing rocker switch 66 to rotate in a counter-clockwise manner (relative to the orientation shown in FIG. 7) about aperture 102. This rotation causes arm 94 to move in an upward direction, thereby exerting an upward force on the PCB 76 and causing PCB 76 to return to its default RJ45 mode of operation.

Figure 9:
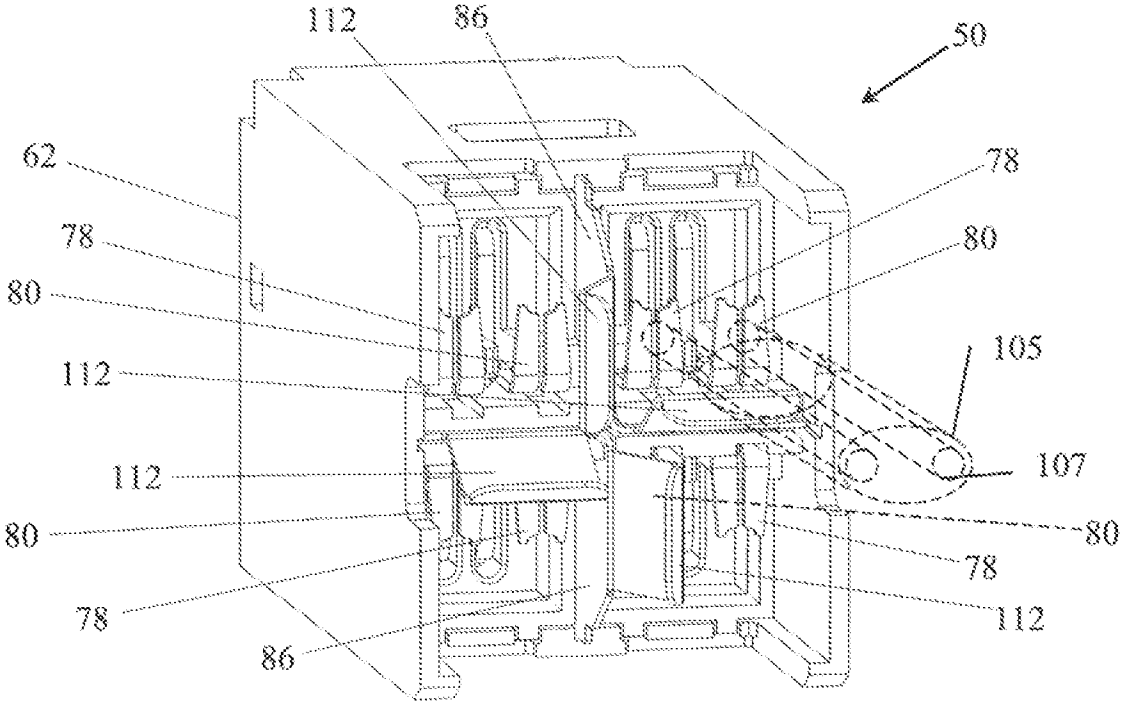
FIG. 9 illustrates rear isometric view of a jack according to an embodiment of the present invention with rear metal caps removed.

A rear isometric view of switchable jack 50 with rear metal caps 88 removed is shown in FIG. 9. Individual conductors of horizontal cable 56 are terminated to respective IDC 78 and 80. In one embodiment, horizontal cable 56 is an S/FTP (shielded/foiled twisted pair) cable, meaning that each conductor pair has its own foil wrap. Flanges 112 on metal IDC isolators 86 extend outwardly so that they make an electrical bond to the individual foil wraps 105 of each conductor 107 pair. This can promote a shielded system by carrying the ground from foil wrap through metal IDC isolators 86 to metal housing 62.

Note that while this invention has been described in terms of several embodiments, these embodiments are non-limiting (regardless of whether they have been labeled as exemplary or not), and there are alterations, permutations, and equivalents, which fall within the scope of this invention. Additionally, the described embodiments should not be interpreted as mutually exclusive, and should instead be understood as potentially combinable if such combinations are permissive. It should also be noted that there are many alternative ways of implementing the methods and apparatuses of the present invention. It is therefore intended that claims that may follow be interpreted as including all such alterations, permutations, and equivalents as fall within the true spirit and scope of the present invention.

We claim:

1. A communication connector, comprising:

a housing configured to receive a communication plug;

a printed circuit board connected to said housing; and a rocker switch pivotally connected to said housing, said rocker switch configured to change a position of said printed circuit board between two different modes of operation depending on a type of said communication plug.

2. The communication connector of claim 1 further including a plug interface contact (PIC) support structure connected to said housing, said rocker switch pivotally connected to said PIC support structure.

3. The communication connector of claim 2, wherein said PIC support structure includes at least one axle connected to said rocker switch.

4. The communication connector of claim 1 further including a plurality of plug interface contacts at least partially within said housing, a plurality of cable contacts, said printed circuit board connected between said plug interface contacts and cable contacts, and a plurality of signal pairs extending from respective said plug interface contacts to respective said cable contacts.

5. The communication connector of claim 4 further including at least one cable contact isolator, wherein one of said plurality of signal pairs is at least partially isolated from another of said plurality of signal pairs at least in part by said at least one cable contact isolator, said circuit board and said at least one cable contact isolator.

6. The communication connector of claim 1, wherein said rocker switch includes a nose deflection region configured for contacting the communication plug.

7. A communication system, comprising:

communication equipment; and a communication connector connected to said communication equipment, said communication connector including a housing configured to receive a communication plug, a printed circuit board connected to said housing, and a rocker switch pivotally connected to said housing, said rocker switch configured to change a position of said printed circuit board between two different modes of operation depending on a type of said communication plug.

8. The communication system of claim 7 further including a plug interface contact (PIC) support structure connected to said housing, said rocker switch pivotally connected to said PIC support structure.

9. The communication system of claim 8, wherein said PIC support structure includes at least one axle connected to said rocker switch.

10. The communication system of claim 7 further including a plurality of plug interface contacts at least partially within said housing, a plurality of cable contacts, said printed circuit board connected between said plug interface contacts and cable contacts, and a plurality of signal pairs extending from respective said plug interface contacts to respective said cable contacts.

11. The communication system of claim 10 further including at least one cable contact isolator, wherein one of said plurality of signal pairs is at least partially isolated from another of said plurality of signal pairs at least in part by said at least one cable contact isolator, said circuit board and said at least one cable contact isolator.

12. A communication connector operable with a first type of a plug corresponding to a first mode of operation and a second type of a plug corresponding to a second mode of operation, said first type of a plug being different from said second type of a plug, said communication connector comprising:

a housing including a plug receiving aperture;

a plug interface contact (PIC) support structure connected to said housing;

a first plurality of adjacently positioned PICs in said plug receiving aperture and supported by said PIC support structure, said first plurality of PICs having a first subset of first contact pairs and a second subset of first contact pairs, said first subset of first contact pairs configured to interface said first type of a plug and said second type of a plug, said second subset of first contact pairs configured to interface said first type of a plug but not said second type of a plug;

a second plurality of PIC positioned non-adjacently to said first plurality of PICs, said second plurality of PICs configured to interface said second type of a plug but not said first type of a plug; and a plurality of ground contacts at least partially within said housing for providing a signal ground for said first subset of first contact pairs when said communication connector is in said second mode of operation, said plurality of ground contacts providing ground balance for each first contact pair of said first subset of first contact pairs.

13. The communication connector of claim 12, wherein said second subset of first contact pairs is grounded when said communication connect is in said second mode of operation, said plurality of ground contacts including said second subset of first contact pairs in said second mode of operation.

14. The communication connector of claim 13, wherein said plurality of ground contacts include one of said ground contacts on either side of each first contact pair of said first subset of first contact pairs.

15. The communication connector of claim 12, further including a rocker switch connected to said PIC support structure.

16. The communication connector of claim 15 further comprising a printed circuit board (PCB), said PCB being positioned in a first position for said first mode of operation and a second position for said second mode of operation, said rocker switch configured to change the position of said PCB between said first position and said second position.

17. The communication connector of claim 16, wherein said second mode of operation is activated upon mating said communication connector with said second type of a plug and deactivated upon decoupling said second type of a plug from said communication connector.

18. The communication connector of claim 17, wherein said rocker switch includes a spring arm, said spring arm positioned springingly against said housing.

19. The communication connector of claim 18, wherein said spring arm exerts at least some first amount of spring force on said housing in said first mode of operation and at least some second amount of spring force on said housing in said second mode of operation, said second amount being greater than said first amount.

20. The communication connector of claim 19, wherein said first amount of spring force is sufficient to reposition said PCB from said second position to said first position upon decoupling said second type of a plug from said communication connector.

* * * * *